United States Patent [19]

Goodwin et al.

[11] Patent Number: 4,967,659

[45] Date of Patent: Nov. 6, 1990

[54] SYSTEM FOR READILY INTERCHANGING AN ADJUSTABLE PRINTING HEAD ON A ROTATABLE SHAFT

[75] Inventors: Eber L. Goodwin, Arlington Heights; Charles T. Richards, Palatine, both of Ill.

[73] Assignee: AM International, Inc., Chicago, Ill.

[21] Appl. No.: 492,226

[22] Filed: Mar. 13, 1990

Related U.S. Application Data

[63] Continuation of Ser. No. 449,121, Dec. 8, 1989, abandoned, which is a continuation of Ser. No. 232,270, Aug. 15, 1988, abandoned, which is a continuation-in-part of Ser. No. 179,192, Apr. 8, 1988, abandoned.

[51] Int. Cl.[5] ..... B41F 27/06; B41F 27/14

[52] U.S. Cl. ..... 101/216; 101/76; 101/378

[58] Field of Search ..... 101/375, 376, 377, 378, 101/76, 216, 219, 141

[56] References Cited

U.S. PATENT DOCUMENTS

| | | | |
|---|---|---|---|
| 2,723,621 | 11/1955 | Payne | 101/377 |
| 2,769,676 | 8/1956 | Buck et al. | 101/375 |
| 3,045,594 | 7/1962 | Buttner | 101/375 |
| 3,064,566 | 11/1962 | McVicker | 101/377 |
| 3,376,814 | 4/1968 | Schollenberger | 101/378 |
| 3,603,256 | 9/1971 | Moos et al. | 101/378 |
| 3,724,370 | 4/1973 | Martin | 101/377 |
| 4,572,069 | 2/1986 | Schwarzbeck | 101/76 |
| 4,580,492 | 4/1986 | Troyan et al. | 101/377 |
| 4,590,858 | 5/1986 | Sedlak et al. | 101/76 |
| 4,756,245 | 7/1988 | Roch | 101/227 |

*Primary Examiner*—Clifford D. Crowder

*Attorney, Agent, or Firm*—Nicholas A. Camasto; John R. Hoffman

[57] ABSTRACT

In a duplicating machine, a system for readily interchanging a printing head on a permanent rotatable shaft of a printing couple of the machine, to facilitate rapid changing of printed indicia in short run duplicating situations. An elongated manually manipulatable segment is readily removably mountable on the rotatable shaft. At least one ring-like mounting member is fixable to the manually manipulatable segment at any position therealong. At least one adjustable printing head is secured to the mounting member. The manually manipulatable segment can be bodily removed from the shaft and the printing head can be replaced or adjusted while the machine continues to operate.

39 Claims, 4 Drawing Sheets

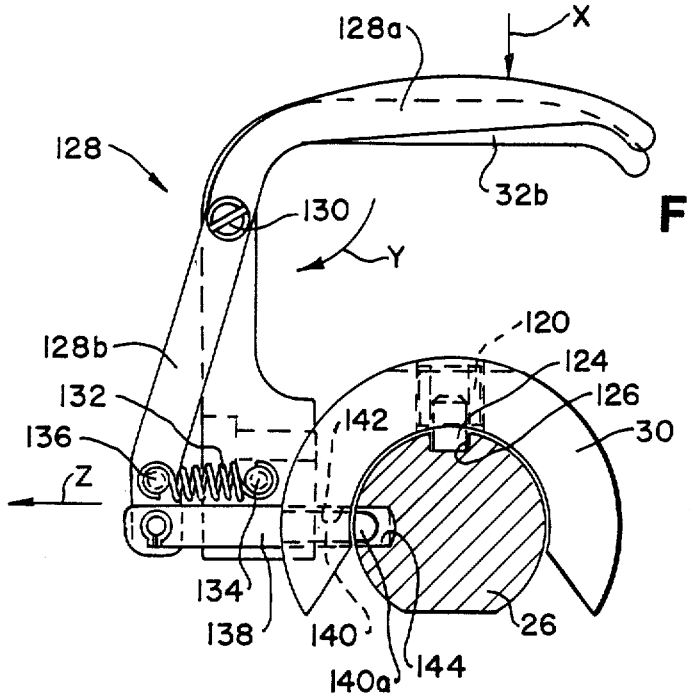
Fig. 15
Fig. 16
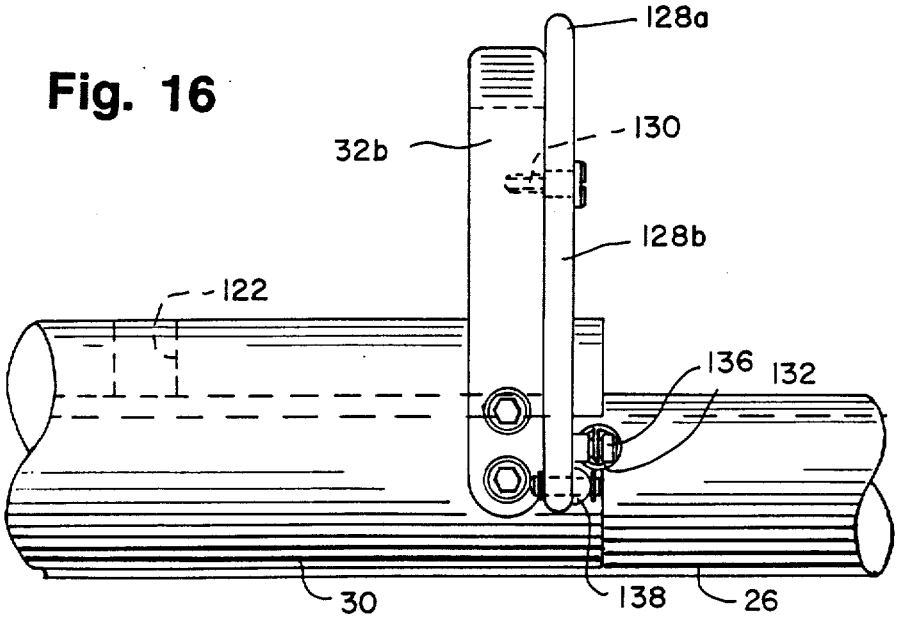

SYSTEM FOR READILY INTERCHANGING AN ADJUSTABLE PRINTING HEAD ON A ROTATABLE SHAFT

This application is a continuation of application Ser. No. 449,121, filed Dec. 8, 1989, which was a continuation of Ser. No. 232,270, filed Aug. 15, 1988, which was a continuation-in-part of Ser. No. 179,192, filed Apr. 8, 1988, all now abandoned.

FIELD OF THE INVENTION

This invention generally relates to duplicating machines, and, particularly, to a system for readily interchanging printing heads during short run serial-type printing, such as might be employed in printing numbers on bank checks, information on deposit slips, indicia on letter heads or the like.

BACKGROUND OF THE INVENTION

Printing machines, such as rotary offset lithographic duplicating machines, rotary printing presses, or the like normally include a printing couple which comprises a number of cylinders and/or rollers for supplying ink from a reservoir. In offset lithographic machines, moisture also is supplied from a reservoir. The machine includes a printing couple which comprises a number of cylinders and/or rollers such as impression cylinders, master cylinders, blanket cylinders, form rollers, ductor rollers, transfer rollers and the like. Such duplicating machines have been known and used for many years and, today, have become rather sophisticated in high-speed duplicating or printing processes.

An important area in which such duplicating machines have found wide utility is in short run printing. Short run printing jobs encompass a wide range of applications where printing is needed for several hundred sheets, for instance, versus more production oriented applications where the machine is set up and thousands of sheets are duplicated, such as in printing magazines, advertising brochures or the like.

An example of a "short run" duplicating application is in printing bank checks, deposit slips and the like. Every bank employs a particular printing company which prints checks and deposit slips for its customers. The checks usually come in standard styles and a machine may be set up to print a given style with the appropriate repeating indicia thereon. However, for each customer order, which may constitute only a few hundred checks, each check must be imprinted with the name of the bank, the name and address of the customer, the customer's deposit account number, as well as serially printing the check numbers, in order, as a printing run proceeds. In order to avoid excessive costs and resulting charges for such short run printing jobs, printing concerns and duplicating machine manufacturers constantly are endeavoring to design new and improved systems, attachments or mechanisms to speed up change-over procedures from one printing run to the next.

Another example of short run printing is in the area of imprinting different identifications, logos, or the like which may vary but which must be imprinted along with other more permanent identification indicia. Letterheads are but one example. A large company, such as an insurance company, may have a standard letterhead form for the parent company. However, the company may have many, many branch offices around the country. Each standard letterhead form must be imprinted, again in short runs, to continuously supply stationery to the branch offices, with the branch office identification imprinted thereon. Still further, each branch office may have separate stationery for many individuals employed or working in that office, and the stationery must be imprinted further with an individual's name and position.

A further example of short run printing is in the area of encoding. Department stores and grocery stores, for instance, now have coded price labels (i.e. encoding bars) which are printed in large volumes but with many different price codes. There may be many labels on a single printing sheet, resulting in the printing machine employing a multiplicity of individual printing heads on a single roller or shaft for printing the labels.

These are but some examples of the wide range of short run duplicating situations where rapid changing of printed indicia is necessary.

As stated above, most duplicating machines of the character described employ many different types of rollers, all of which are precisely positioned and aligned in parallel to effect high quality, rapid printing. Therefore, providing a system for rapid interchanging of printing heads for short run duplicating situations involves high precision techniques. Usually, the printing heads are mounted on a rigid shaft or roller adjacent the ink fountain rollers of the machine. Some prior machines simply have the interchangeable or adjustable printing heads, for short run printing, mounted directly on the permanent shaft. Each time the printing heads have to be changed, in order to change or reset the numbers, change to another office or individual's name, or change a price code, the machine had to be shut down to make the adjustments. It can be seen that with some short run printing situations, the machine downtime would be as much as its production time.

Other attempts have been made to provide for interchanging the machine shaft itself. However, it must be kept in mind that such precision shafts are very heavy and, in combination with the printing heads and mounting brackets associated therewith, can even be too heavy and cumbersome for some individuals to handle. In addition, interchangeable shafts create tolerance problems. A shaft in quality duplicating machines often must be maintained within thousandths or tens of thousandths of an inch in tolerances. Interchangeable shafts simply cannot maintain this precision, much less avoid disturbing micro-switches, timing cams, etc. which are associated with the shaft. These mechanisms must be uncoupled and, in essence, such prior procedures literally constitute a type of dismantling of the machine, even though they allow for adjusting or interchanging the printing heads off of the machine while another printing run is being performed. Still, the downtime in dismantling and removing a shaft assembly is considerable, in addition to the lack of quality printing which is often encountered.

This invention is directed to solving the above problems and satisfying the continuing need for providing rapid changing of printed indicia in duplicating or printing machines.

SUMMARY OF THE INVENTION

An object, therefore, of the invention is to provide a new and improved system for readily interchanging a printing head or heads on a rotatable shaft of a printing couple in a duplicating machine, to facilitate rapid changing of printer indicia in short run duplicating situations, for instance.

In the exemplary embodiment of the invention, a manually manipulatable segment is readily removably mountable on a permanent rotatable shaft of the duplicating machine. At least one mounting member is fixable to the manually manipulatable segment. At least one adjustable printing head is secured to the mounting member. With this combination, the manually manipulatable segment can be bodily removed from the permanent shaft and the printing head can be replaced or adjusted while the machine continues to operate on a succeeding printing run.

More particularly, the manually manipulatable segment is elongated and of a generally semi-cylindrical configuration. The segment defines an elongated opening of a width at least equal to the diameter of the permanent shaft for readily removably mounting the segment on the shaft in a direction transverse thereto.

Manually graspable handles are provided at opposite ends of the semi-cylindrical segment and quick-release latches are mounted on the shaft for engaging the opposite ends of the segment. Therefore, the latches can be released in conjunction with manual motions in grasping the handles to remove the segment from the shaft.

With the semi-cylindrical segment being elongated, a number of printing heads can be mounted thereon at any position along the segment for printing at any position on the copy sheets. With a plurality of such segments, one segment can be removed from the machine and interchanged with another segment which has printing heads thereon already adjusted for the next printing run. While that run is being processed, the one segment and its printing heads can be adjusted and be made ready for replacement on the permanent shaft of the machine for the next succeeding printing run. This interchangement of the single segment and its multiplicity of printing heads literally can be performed in a matter of seconds. All adjustments of the printing heads are carried out while the machine is in operation and a bare minimum amount of downtime is caused as compared to most prior art systems.

A safety latch feature also is incorporated with the invention for holding the elongated manually manipulatable segment on the shaft. The safety latch means is effective to automatically latch the segment in response to mounting the segment in proper position on the shaft.

There are other useful and convenient features of the invention which will be described hereinafter, along with other objects and advantages, as will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

FIG. 15 is a cross section through the shaft and illustrating, in an elevation, another embodiment of a safety latch mechanism of the invention; and FIG. 16 is a front elevation of the safety latch mechanism of FIG. 15, with the shaft and one end of the segment fragmented.

DETAILED DESCRIPTION OF THE PREFERRED EMBODIMENT

Figure 1:
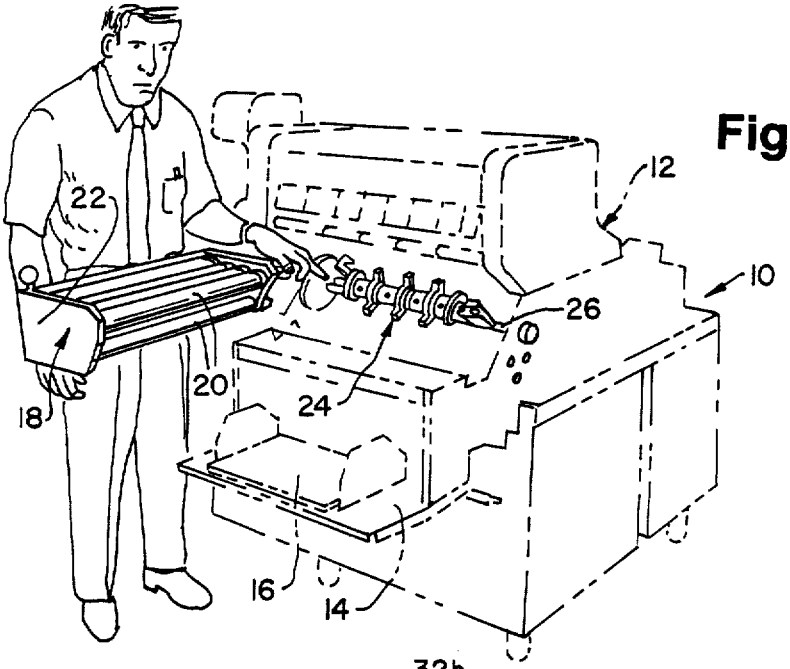
FIG. 1 is a perspective view of a rotary offset lithographic duplicating machine, shown in phantom, incorporating the system of the invention adjacent a swing-out ink fountain above the discharge end of the machine, as shown in full lines.

Referring to the drawings in greater detail, and first to FIG. 1, a conventional rotary offest lithographic duplicating machine is shown in phantom and generally designated 10. The machine has a standard printing couple, generally designated 12, which includes conventional cylinders and rollers for feeding ink through the printing couple and transferring images to copy sheets. The printed sheets are delivered to a discharge end 14 of the machine. For short run duplicating jobs, as described hereinafter, a removable tray 16 may be employed at the discharge end of the machine to facilitate removing the printed sheets after the run is completed. An ink fountain assembly, generally designated 18, is disposed above the discharge end of the machine and includes conventional rollers 20 between a pair of side braces 22. The ink fountain is pivotally mounted on the machine for movement to an open position, as shown in full lines in FIG. 1, to gain access to a printing head assembly, generally designated 24, which prints indicia on the copy sheets, as described hereinafter. Such a pivotally mounted ink fountain is known in the art.

The invention is centered around printing head assembly 24 and its association with a permanent or fixed rotatable shaft 26 of the machine. As described fully above, this is the area that has caused problems in the past in enabling rapid changeover or adjustment of the printing heads between short run jobs. As stated, if the printing heads are adjusted to change the printing indicia while they are mounted on shaft 26 between jobs, this caused expensive downtime of the machine. Other approaches which involved interchangeability or complete removal of shaft 26 and the associated printing heads caused the stated problems, including tolerance problems and less than quality printing.

Figure 2:
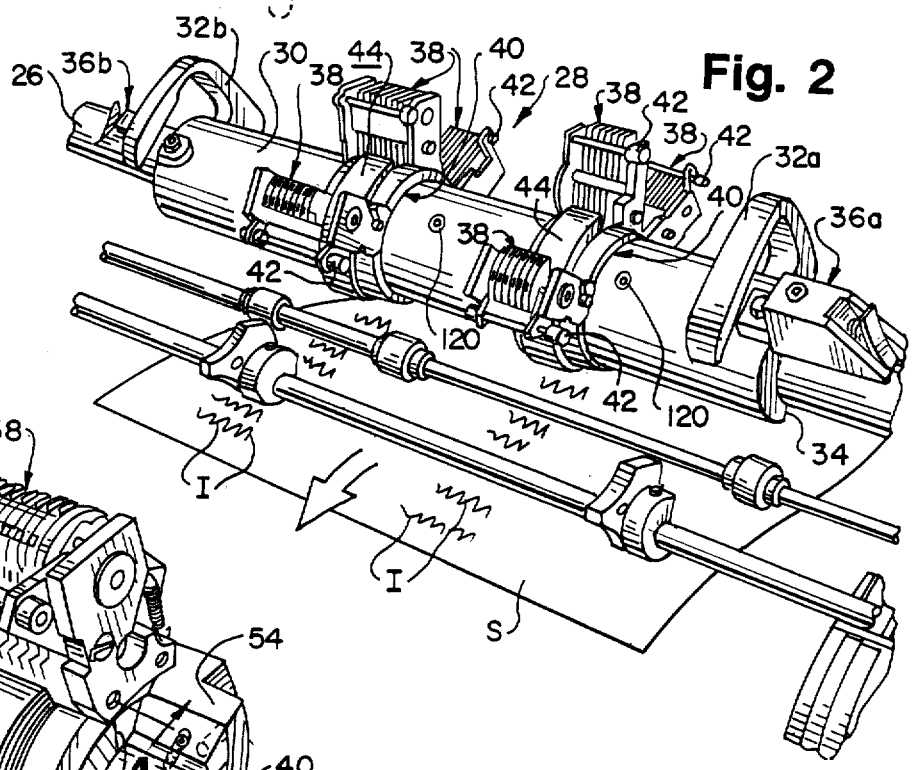
FIG. 2 is a fragmented perspective view, on an enlarged scale, of a printing head assembly, incorporating the concepts of the invention, interchangeably and removably mounted on a permanent shaft of the machine.

FIG. 2 shows the main components of the invention which is embodied in a system for readily interchanging printing heads on rotatable shaft 26 of the printing couple to facilitate rapid changing of the printed indicia on copy sheets in short run duplicating situations. The system involves a complete assembly, generally designated 28 (i.e. 24 in FIG. 1), which is totally removable from shaft 26, leaving the shaft undisturbed, and interchanged by another complete assembly on which the printing heads already have been adjusted for the next printing run or job. This minimizes downtime for the machine and, in fact, interchangement of assemblies 28 can be performed by an operator literally in seconds.

Specifically, assembly 28 shown in FIG. 2 includes a manually manipulatable segment 30 which has a pair of right-hand and left-hand handles 32*a* and 32*b*, respectively, for grasping the segment (i.e. the entire assembly) and moving the assembly onto and off of permanent, rotatable shaft 26 of the machine. As will be seen somewhat more clearly hereinafter, manually manipulatable segment 30 is generally semi-cylindrical in configuration, with an elongated opening 34 extending lengthwise of the segment and of a width at least equal to the diameter of shaft 26. This allows the segment/assembly to be readily mounted on and removed from the shaft in a direction transverse to the shaft.

Quick-release latch means are provided for removably mounting segment 30 on shaft 26. Specifically, this means includes a pair of latch devices, described in greater detail hereinafter, but which are shown in FIG. 2 as a right-hand latch and a left-hand latch, generally designated 36*a* and 36*b*, respectively.

A plurality of printing heads, generally designated 38, are mounted on manually manipulatable segment 30 by means of semi-ring-shaped mounting members, generally designated 40, also described in greater detail hereinafter. It can be seen that three printing heads 38 are mounted on each ring-shaped mounting member 40. These printing heads will not be described in detail because they are standard components that can be purchased from various manufacturers and/or suppliers. The printing heads shown are of a numerical indicia type, such as might be used in printing serialized numbers on bank checks. Suffice it to say, each printing head 38 includes a cam follower 42 which engages an appropriate cam on the machine as shaft 26 rotates to index each printing head to serially print the numerical indicia. For instance, a copy sheet "S" may comprise a plurality of checks which will be cut or separated in a subsequent operation after the numbers are printed thereon, as indicated at "I".

Figure 3:
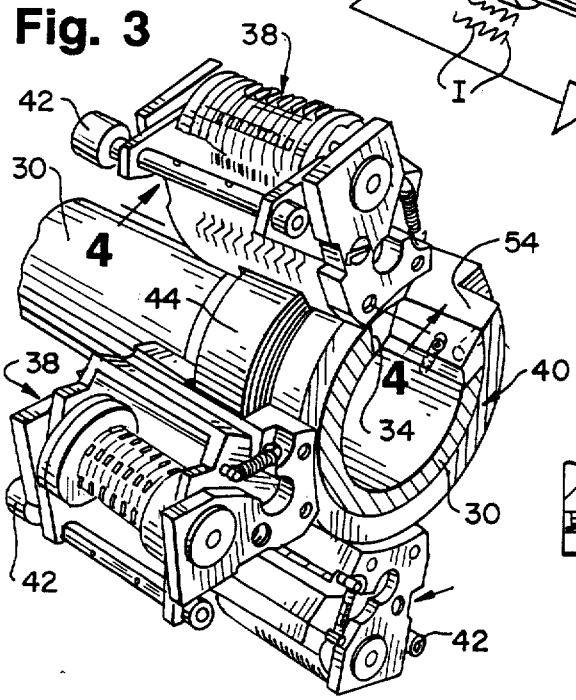
FIG. 3 is a fragmented perspective view, on a further enlarged scale, showing a plurality of printing heads on a mounting ring which is fixable to the manually manipulatable segment of the invention.
Figure 4:
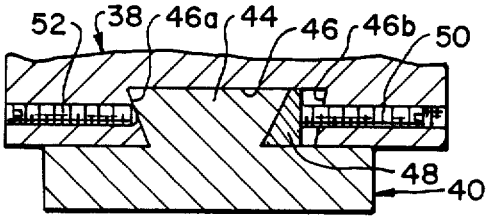
FIG. 4 is a section taken generally along line 4—4 of FIG. 3.

FIGS. 3 and 4 show the manner in which printing heads 38 are mounted on the semi-ring-shaped mounting members 40. The mounting members have annular flanges or ribs 44 about the circumference thereof, the ribs being of a dovetail configuration as shown in FIG. 4. Each printing head 38 has an inside groove 46, one side 46*a* thereof being angled and the other side 46*b* being enlarged for receiving a clamping head 48 on the distal end of a set screw 50. Another set screw 52 is located on the printing head on the opposite side of dovetail rib 44. Therefore, by tightening the set screws, the printing head is clamped to the dovetail rib of the mounting ring for rotation therewith and, therefore, with segment 30 and rotatable shaft 26. This dovetail mounting of the printing heads on the mounting ring is conventional in the art. Lastly, as will be seen more clearly hereinafter, FIG. 3 shows that mounting rings 40 have an opening 54 in alignment with opening 34 in segment 30 to allow assembly 28 to be positioned onto and removed from shaft 26.

Figure 5:
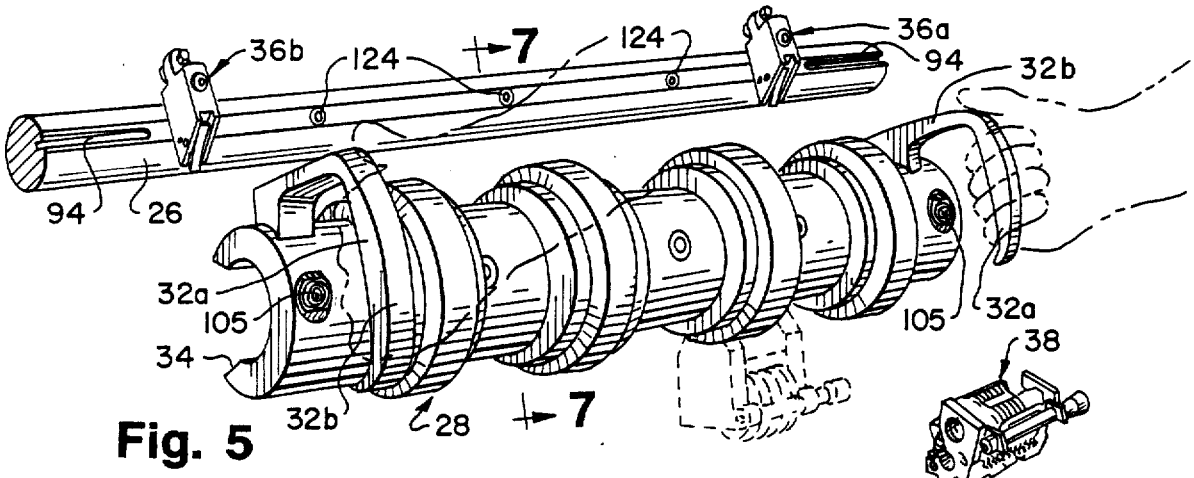
FIG. 5 is a perspective view illustrating the removability of the manually manipulatable segment from the permanent shaft of the machine.

Although quick-release latches 36*a*,36*b* will be described in more detail hereinafter, FIG. 5 (in conjunction with FIG. 2) shows that the latches are pivotally mounted on rotatable shaft 26 so that they are pivotable between latching positions (FIG. 2) and release positions (FIG. 5) whereby assembly 28 can be readily removed from and positioned on the shaft by an operator grasping handles 32*a*,32*b* as depicted in FIG. 5.

Figure 6:
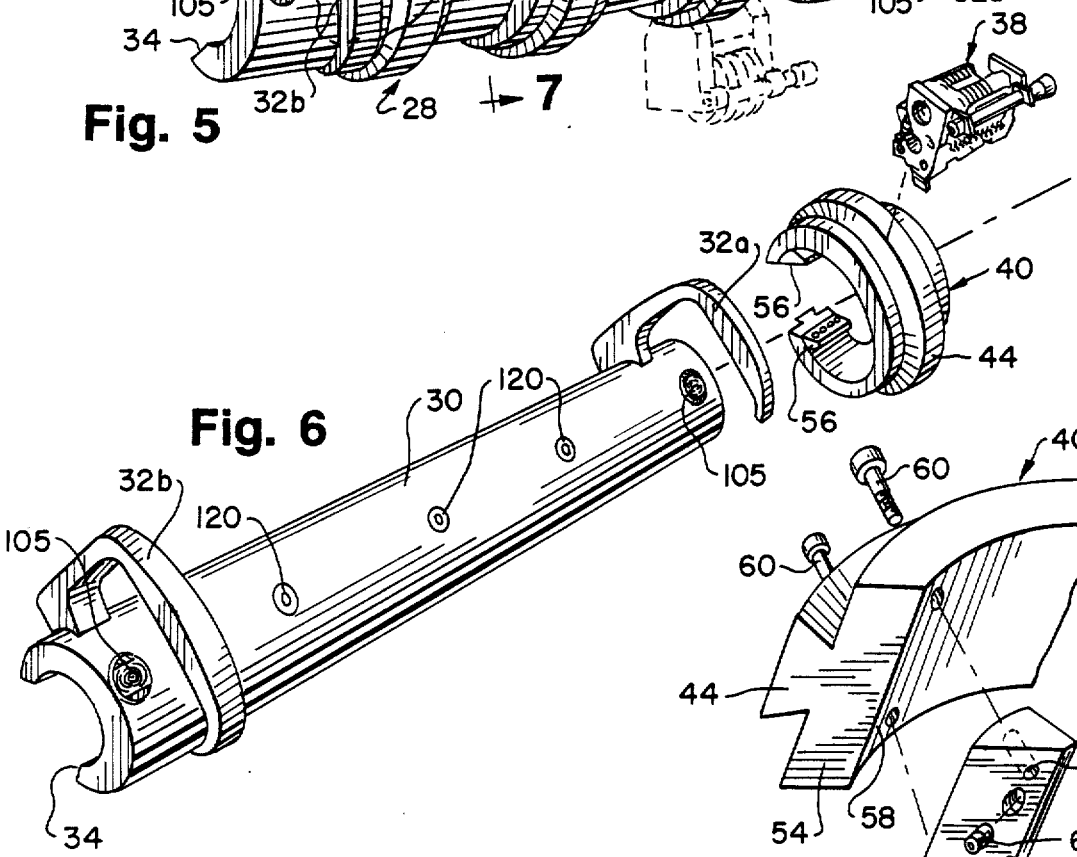
FIG. 6 is an exploded perspective view of the manually manipulatable segment, one of the mounting rings and one printing head.
Figure 8:
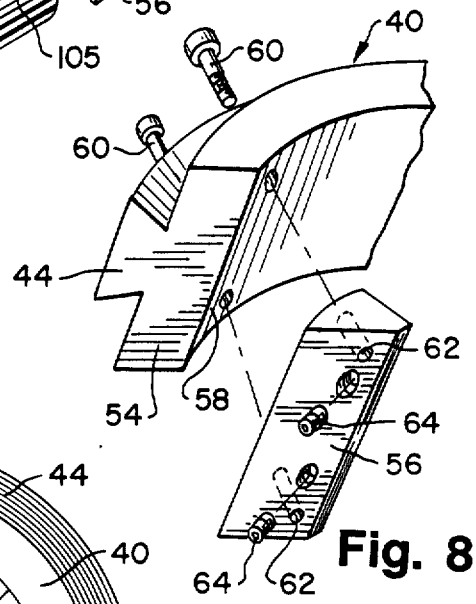
FIG. 8 is a fragmented perspective view of a clamp means for securing each mounting ring on the manually manipulatable segment.
Figure 7:
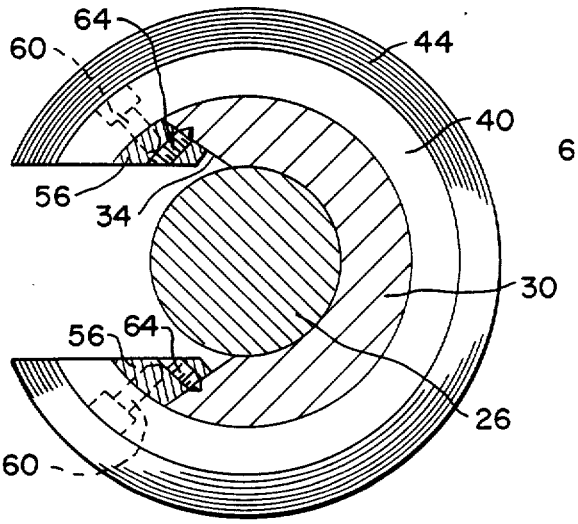
FIG. 7 is a section, on an enlarged scale, taken generally along line 7—7 of FIG. 5.

FIGS. 6–8 show a feature of the invention which involves means for fixing mounting rings 40 to manually manipulatable segment 30 by clamping the rings to the edges of the segment along elongated opening 34 of the segment. Heretofore, prior art mounting rings were made with dovetail ribs 44 for securing printing heads 38 directly to a rotatable shaft, such as shaft 26. The mounting rings had openings sized to slip over the shaft. However, once a ring was positioned over the shaft, a large mounting block was placed into the opening, engaging side edges of the opening, and clamped rigidly to the shaft itself. Such means of the prior art for securing the rings to the shaft applied pressure to the rings which either spread the rings or otherwise caused the rings to get out of concentricity. This deteriorated printing quality.

With the invention, as shown in FIGS. 6–8, means are provided in the form of clamp bars 56 which are fixed to the inside diameter of each ring 40, along the edges 58 (FIG. 8) of opening 54. The clamp bars are fixed by means of bolts 60 passing through the ring and into threaded bores 62 in each bar. The clamp bars, therefore, are fixed in positions as best shown in FIGS. 6 and 7. The rings can be fitted over manually manipulatable segment 30 either before attachment of handles 32*a*,32*b*, or the rings can be mounted on the segment by passing an edge of the segment through the opening in the ring and simply rotating the ring into position. Clamp bars 56 then are fixed to the edges of opening 34 of segment 30, as best seen in FIG. 7, by means of set screws 64. In this manner, it can be seen that the rings are fixed to the segment by clamping each edge of the segment opening and, thereby, cause no spreading forces on the ring which might alter the ring out of its concentricity. Both the ring and the segment remain undisturbed regardless of the clamping forces. Since segment 30 is elongated, a plurality of rings 40 (each able to mount a plurality of printing heads) can be mounted at any position along the segment. This entire assembly 28 can be interchangeably mounted on shaft 26.

Figure 9:
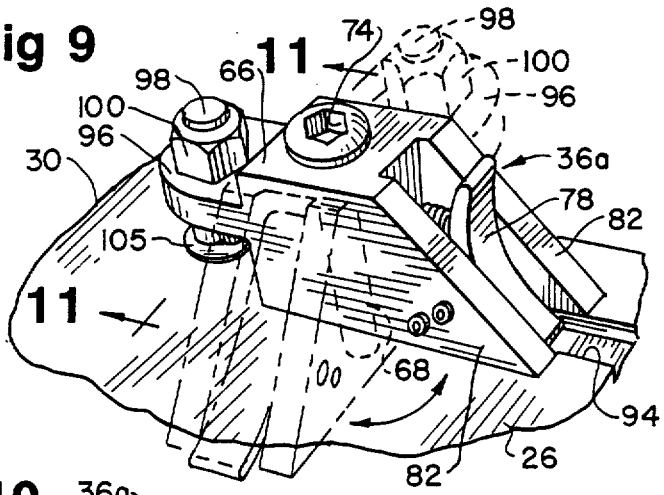
FIG. 9 is a perspective view of one of the quick-release latches for readily removably mounting the manually manipulatable segment on the machine shaft.
Figure 10:
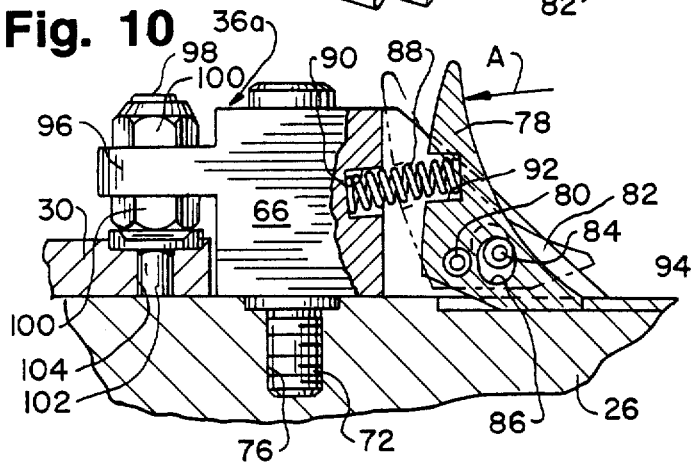
FIG. 10 is an elevational view of the latch of FIG. 9, in its latched condition over the right-hand end of the manually manipulatable segment.
Figure 11:
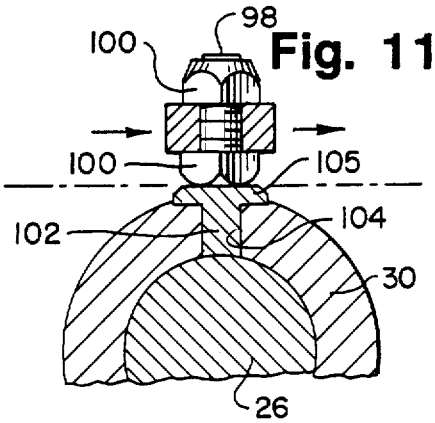
FIG. 11 is a section taken generally along line 11—11 of FIG. 9.

FIGS. 9–11 show the details of the quick-release latch means for removably mounting the manually manipulatable segment 30 onto rotatable shaft 26. As stated above, the quick-release latch means include a pair of latch devices 36*a*,36*b* (FIG. 2) which are pivotally mounted on shaft 26 for movement between latching positions as shown in FIG. 2 and release positions as shown in FIG. 5. The right-hand latch device 36a is shown in FIGS. 9–10.

More particularly, each latch device 36a includes a block 66 which is pivotally mounted to shaft 26 by means of a bolt 68 having a head 70 and a threaded distal end 72. The head includes a hex-socket 74 for receiving an appropriate tool for threading the bolt into a threaded bore 76 in the shaft. This not only mounts the latch device to the shaft, but defines the pivot axis about which the latch moves between its latching position and its release position. A spring loaded retaining tongue or lever 78 is pivotally mounted, as at pin 80, between a pair of ears 82 projecting from block 66. Lever 78 is stabilized by a second pin 84 extending between the ears and into an enlarged slot 86 in the lever. This also defines the limit positions for pivotal movement of the lever about pin 80. The lever is spring loaded by a coil spring 88 seated in a socket 90 in block 66 and a socket 92 on the backside of the lever. Shaft 26 has a keyway 94 of a width slightly wider than lever 78 so that the lever can seat in the keyway as shown in full lines in FIGS. 9 and 10. Spring 88 urges the lever about pivot pin 80 and into keyway 94. This prevents the latch device from pivoting about bolt 72.

In the latching position of latch device 36a, a flange 96 projects outwardly over the adjacent end of manually manipulatable member 30. A threaded stub shaft 98 extends freely through the flange, and a pair of nuts 100 are threaded to the stub shaft on opposite sides of flange 96. This enables vertical adjustment of the position of engagement with manually manipulatable segment 30. Furthermore, the segment is fabricated of lightweight material, such as being extruded of aluminum material, and a hardened steel boss 102 is pressfit within a bore 104 (see FIG. 11) for engagement with either the lower end of stub shaft 98 or the lower nut 100, both of which are made of hardened steel. Therefore, a pressure pad is formed by a head portion 105 of boss 102 on the softer aluminum material of the manually manipulatable segment.

When it is desired to release manually manipulatable segment 30 to permit removal of the segment from shaft 26 for replacement purposes, the top of lever 78 is pushed axially inwardly in the direction of arrow "A" (FIG. 10). This pivots the lever against the biasing of spring 88 and lifts the lever out of keyway 94 in shaft 26. The latch device then can be rotated to the phantom position shown in FIG. 9, whereby flange 96, stub shaft 98 and nuts 100 are pivoted to a position axially removed from the adjacent end of segment 30. The segment now can be freely removed from shaft 26. The left-hand latch device 36b is constructed and operates identical to the structure and operation of latch device 36a, described above.

With this understanding of the operation of latch devices 36a and 36b, the relative positioning of handles 32a and 32b with respect to the latching devices is important. It can be seen that an operator, in one smooth motion, can rotate the latching devices and grasp the handles to remove the manually manipulatable segment. In fact, a skilled operator can actually rotate the latching devices with his fingers in the same motion as grasping the handles to remove the segment.

Figure 12:
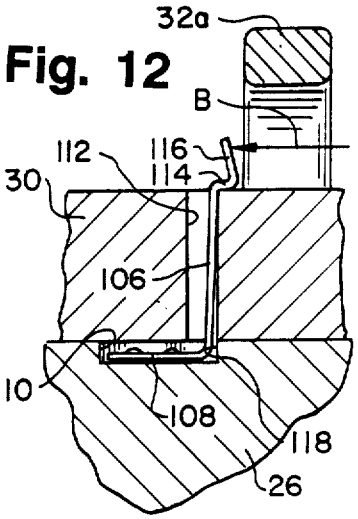
FIG. 12 is a section through the manually manipulatable segment and the machine shaft, illustrating the spring safety latch feature of the invention.

FIG. 12 shows another feature of the invention which includes a safety latch in the form of a spring member 106, having a leg 108 secured within a recess 110 in shaft 26. The spring member projects radially outwardly of the shaft and through a bore 112 in manually manipulatable segment 30. The spring member has an offset shoulder portion 114 which can snap over the top surface of segment 30. An inclined tab portion 116 of the spring member projects still further outwardly in a radial direction. When manually manipulatable segment 30 is positioned onto shaft 26 in a direction transverse thereto, an inner corner 118 of bore 112 engages inclined tab 116 and biases spring member 106 in the direction of arrow "B". Once segment 30 seats against shaft 26, spring member 106 snaps into locking condition over the top of the segment as shown in FIG. 12. When it is desired to remove manually manipulatable segment 30 from shaft 26, spring member 106 simply is moved again in the direction of arrow "B" by an operator's fingers, in the same motion as the operator grasps handle 36a. Like latching devices 36a and 36b, the location of the safety latch means (i.e. snap spring 106) is located intentionally such that an operator can carry out all of the functions afforded by these mechanisms in a singular continuous motion by manual manipulation of the operator's hands and fingers. An identical spring latch means is provided at the other end of segment 30, but facing in the opposite direction.

Figure 13:
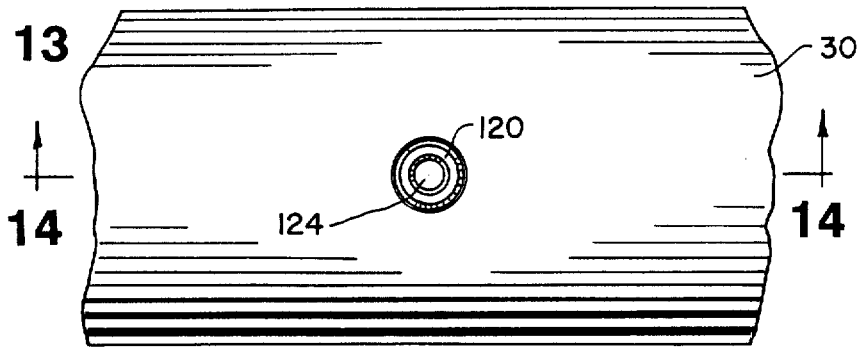
FIG. 13 is a plan view of the pin and bushing means for locating the segment on the shaft.
Figure 14:
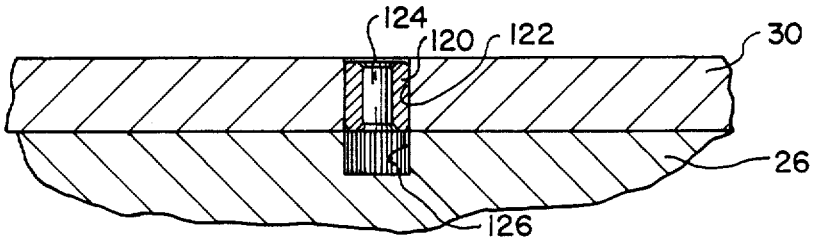
FIG. 14 is a section taken generally along line 14—14 of FIG. 13.

FIGS. 13 and 14 show means for properly locating manually manipulatable segment 30 onto shaft 26 so that the segment and its associated printing heads are located precisely within the printing couple to effect quality printing. As stated above, shaft 26 is a permanent component of the duplicating machine and is located therein, with precision, in conjunction with the other rollers and cylinders of the machine. Heretofore, by mounting rings 40 directly on the shaft, the rings used keys for positioning within elongated keyways extending lengthwise of the shaft. Such key ways could not be manufactured with precision because of their length. On the other hand, pins and bushings can be fabricated with ultimate precision by tool and die processes. Therefore, notwithstanding the fact that manually manipulatable segment 30 is fabricated of lightweight aluminum material, FIGS. 13 and 14 show a bushing 120 seated within a bore 122 of segment 30 for receiving a complementary pin 124 seated in a recess 126 in shaft 26. This pin and bushing arrangement precisely locates the segment on the shaft. As shown in FIGS. 2, 5 and 6, a plurality of the pin and bushing locating means are provided lengthwise or axially of the segment and shaft.

FIGS. 15 and 16 show another embodiment of a safety latch mechanism, generally designated 128, for holding manually manipulatable segment 30 on shaft 26 automatically in response to mounting the segment in proper position on the shaft. In other words, one of the pins 124 is shown in FIG. 15 within its respective recess 126 in shaft 26 and surrounded by its bushing 120, for precisely locating segment 30 on shaft 26. When so precisely located, safety latch mechanism 128 automatically latches the segment to the shaft. In addition, the safety latch mechanism is constructed for releasing the latching mechanism as a function of grasping one of handles 32a, 32b. Latching mechanism 128 is shown in FIGS. 15 and 16 in conjunction with handle 32b. However, a latching mechanism can be associated with either or both handles, preferably both.

More particularly, latching mechanism 128 includes a bell crank member having a first leg 128a and a second leg 128b. The bell crank member is pivoted to handle 32b at 130. A coil spring 132 is stretched under tension and is operative between the lower end of handle 132b and the distal end of bell crank leg 128b, as at 134 and 136, respectively. A latching pin 138 is secured to the distal end of bell crank leg portion 128b and has a head portion 140 freely movable within a bore 142 through segment 30. A recess 144 is properly located in the side of shaft 126 for receiving the distal end 140a of head 140 of pin 138. The latching mechanism 128 as just described is shown in FIG. 15 in its latching condition.

In operation of safety latching mechanism 128, when an operator grasps handle 32b, the operator of necessity must grasp leg portion 128a. This can be seen from the close juxtaposition of the bell crank member with handle 32b as shown in FIG. 16. When this happens, leg portion 128a will be depressed in the direction of arrow "X" in FIG. 15. The bell crank member correspondingly will pivot in the direction of arrow "Y", causing the distal end of leg portion 128b to move in the direction of arrow "Z". This pulls the distal end 140a of pin head portion 140 out of recess 144 in shaft 26, against the biasing of spring 132. The manually manipulatable segment 30, along with all of its associated components, now can be lifted off of the shaft. When the manually manipulatable segment is positioned onto the shaft, with pins 124 precisely locating the segment in recesses 126 in the shaft, the distal end 140aof pin head portion 140 automatically will snap into recess 144 of shaft 26 under the biasing of spring 132.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

We claim:

1. In a duplicating machine, a system for readily interchanging an adjustable printing head on a rotatable shaft of a printing couple to facilitate rapid changing of printed indicia in short run duplicating situations, comprising:

an elongated manually manipulatable segment readily removably mountable on said rotatable shaft and extending axially along the shaft substantially the entire width of the printing area of the printing couple;

at least on mounting member fixable to the manually manipulatable segment at any longitudinal position therealong; and at least one adjustable printing head secured to the mounting member, whereby the manually manipulatable segment can be bodily removed from the shaft, and the printing head can be replaced or adjusted with the segment removed while the machine can continue to operate.

2. In a duplicating machine as set forth in claim 1, including quick-release latch means for removably mounting the manually manipulatable segment on the rotatable shaft.

3. In a duplicating machine as set forth in claim 1, wherein said manually manipulatable segment is elongated for receiving a plurality of the mounting members therealong lengthwise of the shaft.

4. In a duplicating machine as set forth in claim 3, including complementary interengaging means between the manually manipulatable segment and each mounting member for fixing the mounting member at any position lengthwise along the manually manipulatable segment.

5. In a duplicating machine as set forth in claim 3, wherein said manually manipulatable segment is of a generally semi-cylindrical configuration with an elongated opening of a width at least equal to the diameter of the shaft for readily removably mounting the segment on the shaft in a direction transverse thereto.

6. In a duplicating machine as set forth in claim 5, wherein said mounting member is generally semi-ring-shaped, and including means for fixing the mounting member to edge portions of the manually manipulatable segment on opposite sides of said opening.

7. In a duplicating machine as set forth in claim 5, wherein said manually manipulatable segment is elongated for receiving a plurality of the mounting members therealong lengthwise of the shaft.

8. In a duplicating machine, a system for readily interchanging an adjustable printing head on a rotatable shaft of a printing couple to facilitate rapid changing of printed indicia in short run duplicating situations, the improvement comprising an elongated, generally semi-cylindrical manually manipulatable segment having an opening extending lengthwise thereof and of a width at least equal to the diameter of the shaft for readily removably mounting the segment on the shaft in a direction transverse thereto, the elongated manually manipulatable segment extending axially along at least fifty percent of the length of the shaft, and a mounting member fixable at any longitudinal position along said segment for mounting at least one said printing head whereby the segment can be bodily removed from the shaft, and the printing head can be replaced or adjusted with the segment removed while the machine can continue to operate.

9. In a duplicating machine as set forth in claim 8, including quick-release latch means for removably mounting the manually manipulatable segment on the rotatable shaft.

10. In a duplicating machine as set forth in claim 9, wherein said quick-release latch means include a latch device at each opposite end of the elongated segment.

11. In a duplicating machine as set forth in claim 10, including a hand graspable handle at each opposite end of the elongated segment whereby the latch devices can be released in conjunction with manual motions in grasping the handles.

12. In a duplicating machine as set forth in claim 10, wherein each latch device comprises a latch member pivotally mounted to the shaft for movement between a latching position overlying the adjacent end of the elongated segment and a release position freeing the segment for ready removal from the shaft.

13. In a duplicating machine as set forth in claim 12, wherein the latch device includes lock means for holding the device in said latching position.

14. In a duplicating machine as set forth in claim 8, including locating means between the elongated segment and the shaft for precisely locating the segment angularly and axially of the shaft.

15. In a duplicating machine as set forth in claim 14, wherein said locating means include a plurality of pins on one of the segment and the shaft positionable in mating bushings in the other of the segment and the shaft.

16. In duplicating machine as set forth in claim 15, wherein said elongated segment is fabricated of lightweight metal material and said pins and bushings are fabricated of hardened metal of precise mating dimensions.

17. In a duplicating machine as set forth in claim 8, including safety latch means for holding the elongated segment on the shaft.

18. In a duplicating machine as set forth in claim 17, wherein said safety latch means include a spring member fixed to the shaft and configured to snap into latching engagement with the segment automatically in response to mounting the segment in proper position on the shaft.

19. In a duplicating machine as set forth in claim 17, including a hand graspable handle on the elongated segment and wherein said safety latch means include a locking mechanism operatively associated between the elongated segment and the shaft and means for releasing the latching mechanism as a function of grasping the handle.

20. In a duplicating machine as set forth in claim 19, wherein said latching mechanism is spring loaded to snap into latching engagement with the segment automatically in response to mounting the segment in proper position on the shaft.

21. In a duplicating machine as set forth in claim 19, wherein said latching mechanism includes a first portion for locking engagement with the shaft and a second portion immediately adjacent the graspable handle whereby the second portion can be grasped simultaneously with grasping the handle to move the second portion out of locking engagement with the shaft.

22. In a duplicating machine as set forth in claim 21, wherein said latching mechanism includes spring means for biasing the second portion into locking engagement with the shaft automatically in response to properly positioning the segment on the shaft.

23. In a duplicating machine as set forth in claim 21, wherein said latching mechanism includes a bell crank member having a first leg defining said first portion extending along and in juxtaposition with the graspable handle, and a second leg having said second portion thereon.

24. In a duplicating machine as set forth in claim 23, wherein said latching mechanism includes spring means for biasing the second portion into locking engagement with the shaft automatically in response to properly positioning the segment on the shaft.

25. In a duplicating machine as set forth in claim 8, wherein said mounting member is generally semi-ring-shaped, and including means for fixing the mounting member to edge portions of the manually manipulatable segment on opposite sides of said opening.

26. In a duplicating machine, a system for readily interchanging an adjustable printing head on a rotatable shaft of a printing couple to facilitate rapid changing of printed indicia in short run duplicating situations, comprising:

a manually manipulatable segment readily removable mountable on said rotatable shaft and extending axially along the shaft substantially the entire width of the printing area of the printing couple;

at least one mounting member fixable to the manually manipulatable segment at any longitudinal position therealong;

at least one adjustable printing head secured to the mounting member, whereby the manually manipulatable segment can be bodily removed from the shaft, and the printing head can be replaced or adjusted with the segment removed while the machine can continue to operate; and safety latch means for holding the manually manipulatable segment on the shaft automatically in response to mounting the segment in proper position on the shaft.

27. In a duplicating machine as set forth in claim 26, wherein said safety latch means include a spring member fixed to the shaft and configured to snap into latching engagement with the segment automatically in response to mounting the segment in proper position on the shaft.

28. In a duplicating machine as set forth in claim 26, including a hand graspable handle on the manually manipulatable segment and wherein said safety latch means include a locking mechanism operatively associated between the elongated segment and the shaft and means for releasing the latching mechanism as a function of grasping the handle.

29. In a duplicating machine as set forth in claim 28, wherein said latching mechanism is spring loaded to snap into latching engagement with the segment automatically in response to mounting the segment in proper position on the shaft.

30. In a duplicating machine as set forth in claim 28, wherein said latching mechanism includes a first portion for locking engagement with the shaft and a second portion immediately adjacent the graspable handle whereby the second portion can be grasped simultaneously with grasping the handle to move the second portion out of locking engagement with the shaft.

31. In a duplicating machine as set forth in claim 30, wherein said latching mechanism includes spring means for biasing the second portion into locking engagement with the shaft automatically in response to properly positioning the segment on the shaft.

32. In a duplicating machine as set forth in claim 30, wherein said latching mechanism includes a bell crank member having a first leg defining said first portion extending along and in juxtaposition with the graspable handle, and a second leg having said second portion thereon.

33. In a duplicating machine as set forth in claim 32, wherein said latching mechanism includes spring means for biasing the second portion into locking engagement with the shaft automatically in response to properly positioning the segment on the shaft.

34. In a duplicating machine, a system for readily interchanging an adjustable printing head changing of printed indicia, the improvement comprising an elongated manually manipulatable segment positionable on said shaft, and extending axially along the shaft substantially the entire width of the printing area of the printing couple, quick-release latch means for readily removably securing the segment on the shaft, and a mounting member fixable at any position lengthwise along the segment for mounting at least one said printing head whereby the segment can be bodily removed from the shaft, and the printing head can be replaced or adjusted with the segment removed while the machine can continue to operate.

35. In a duplicating machine as set forth in claim 34, wherein said quick-release latch means include a latch device at each opposite end of the elongated segment.

36. In a duplicating machine as set forth in claim 35, including a hand graspable handle at each opposite end of the elongated segment whereby the latch devices can be released in conjunction with manual motions in grasping the handles.

37. In a duplicating machine as set forth in claim 35, wherein each latch device comprises a latch member pivotally mounted to the shaft for movement between a latching position overlying the adjacent end of the elongated segment and a release position freeing the segment for ready removal from the shaft.

38. In a duplicating machine as set forth in claim 35, wherein the latch device includes lock means for holding the device in said latching position.

39. In a duplicating machine as set forth in claim 34, wherein said manually manipulatable segment is generally semi-cylindrical, and said mounting member for the printing heads include generally semi-ring-shaped members, and including clamp means at edge portions of the semi-ring-shaped members for clamping the edges of the segment at said opening.

* * * * *